US005606758A

United States Patent [19]

Tung

[11] Patent Number: 5,606,758

[45] Date of Patent: Mar. 4, 1997

[54] MULTI-PURPOSE TOOL

[76] Inventor: Yi-ming Tung, No. 23, Tzuchiang 2nd St., Wuchi Chen, Taichung Hsien, Taiwan

[21] Appl. No.: 543,737

[22] Filed: Oct. 16, 1995

[51] Int. Cl.[6] ..... B25B 13/00

[52] U.S. Cl. ..... 7/138; 81/440; 81/490

[58] Field of Search ..... 7/138, 158, 165; 81/58.3, 439, 440, 490

[56] References Cited

U.S. PATENT DOCUMENTS

| | | | |
|---|---|---|---|
| 4,676,703 | 6/1987 | Swanson | 81/440 X |
| 5,329,834 | 7/1994 | Wong | 81/439 X |
| 5,450,775 | 9/1995 | Kozak | 81/490 X |

*Primary Examiner*—James G. Smith
*Attorney, Agent, or Firm*—Ross, Clapp, Korn & Montgomery, L.L.P.

[57] ABSTRACT

A multi-purpose tool includes a head portion, a handle portion coupled to the head portion, and a plurality of hexagon rods received in the head portion and the handle portion. The head portion has a first end, a central hexagon hole defined therein extending from a second end thereof to the first end and a ratchet mechanism coupled the first end thereof. The ratchet mechanism includes a central shaft having a central hexagon aperture in alignment with the central hexagon hole of the head portion. The handle portion has a first end coupled to the second end of the head portion, a central hexagon opening defined therein extending from a second end to the first end thereof and in alignment with the hexagon hole of the head portion. The handle portion is capable of pivoting about the head portion with a first axial movement of the handle portion relative to the head portion in a first direction. The plurality of hexagon rods are received in the hexagon opening, hexagon hole and the hexagon aperture of the handle portion, the head portion and the shaft of the ratchet mechanism respectively and arranged such that a portion of one of the plurality of hexagon rods extending out from the ratchet mechanism and a portion of another hexagon rod extending out from the second end of the handle portion. Each of the plurality of the hexagon rods has two contracted ends formed into various functional shapes for performing different tool functions.

12 Claims, 6 Drawing Sheets

MULTI-PURPOSE TOOL

BACKGROUND OF THE INVENTION

1. Field of the Invention

The present invention generally relates to household tools and, more particularly, to a multi-purpose tool self-containing a number of functional bits each has two functional ends of different functions, such as, Phillips head tip, keystone tip, cabinet-tip and hex wrench head etc., and can be continently interchanged to perform various functions.

2. Description of Related Art

Screwdrivers and Allen wrenches are the tools that are commonly used tools for tightening and loosening objects joined by screws and Allen screws. Because there are different type of screw heads, for instances, Phillips head, slotted head, thus one has to have a number of different type screwdrivers in order to handle every possible type of screws he may encounter. Although a bit-exchangeable screwdriver has been commercially available to solve the above problem, this type of screwdriver, however, still need a series of bits which are kept in a separate case and thus is inconvenient to carry around and may subject to lost.

Similarly, there are all sizes of Allen screws which require a set of Allen wrenches in different diameters in order to work with Allen screws of different sizes. Again, carrying a large number of Allen ranches around is not a convenient way of working.

Therefore, there has been a long and unfulfilled need for a handy tool which can contain various type of bits of screwdrivers and Allen wrench heads in different diameters within itself such that the tool can be carried conveniently. If desired, a number of tool-heads, such as, an open-end portion of a wrench, a box-end portion of a wrench or a hammerhead, can be readily attached to the tool to perform additional tool functions.

SUMMARY OF THE INVENTION

The main purpose of the present invention is to provide a tool that is capable of performing various tool functions simply by continently exchanging functional tool-head components which are self-contained within the tool.

Another purpose of the present invention is to provide a tool that is capable of performing various tool functions either by exchanging functional tool-head components which are self-contained within the tool or by attaching different tool-head parts to the tool.

The present invention provides a multi-purpose tool includes a head portion, a handle portion coupled to the head portion, and a plurality of hexagon rods received in the head portion and the handle portion. The head portion has a first end, a central hexagon hole defined therein extending from a second end thereof to the first end and a ratchet mechanism coupled the first end thereof. The ratchet mechanism includes a central shaft having a central hexagon aperture in alignment with the central hexagon hole of the head portion.

The handle portion has a first end coupled to the second end of the head portion, a central hexagon opening defined therein extending from a second end to the first end thereof and in alignment with the hexagon hole of the head portion. The handle portion is capable of pivoting about the head portion with a first axial movement of the handle portion relative to the head portion in a first direction.

The plurality of hexagon rods are received in the hexagon opening, hexagon hole and the hexagon aperture of the handle portion, the head portion and the shaft of the ratchet mechanism respectively and arranged such that a portion of one of the plurality of hexagon rods extending out from the ratchet mechanism and a portion of another hexagon rod extending out from the second end of the handle portion. Each of the plurality of the hexagon rods has two contracted ends formed into various functional shapes for performing different tool functions.

In accordance with one aspect of the present invention, a holding structure is provided in a first end of the hexagon aperture of the shaft of the ratchet mechanism, the second end of the hexagon hole of the head portion, both end of the hexagon opening of the handle portion respectively to properly retain the hexagon rods in position.

In accordance with another aspect of the present invention, the holding structure includes two ball shaped ridges slightly extending inward from two opposite walls defining the hexagon hole/opening/aperture.

In accordance with a further aspect of the present invention, the functional shapes of the hexagon rods are Allen wrenches of various diameters.

In accordance with still a further aspect of the present invention, one of the functional shapes of the hexagon rods is a keystone tip of a screwdriver.

In accordance with still a further aspect of the present invention, one of the functional shapes of the hexagon rods is a Phillips head tip of a screwdriver.

In accordance with still a further aspect of the present invention, one of the functional shapes of the hexagon rods is a cabinet tip of a screwdriver.

In accordance with another embodiment of the present invention, the tool further includes a connecting portion having a first end releasably coupled to the second end of the handle portion and a second end; and a tool-head component having a first end releasably coupled to the second end of the extension portion and a functional body.

In accordance with one aspect of this embodiment, the functional body of the tool-head component is an open-end portion of a wrench.

In accordance with another aspect of this embodiment, the functional body of the tool-head component is a box-end portion of a wrench.

In accordance with a further aspect of this embodiment, the functional body of the tool-head component a blade portion of a saw.

In accordance with one aspect of this embodiment, the functional body of the tool-head component is an is a hammer-head of a hammer.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
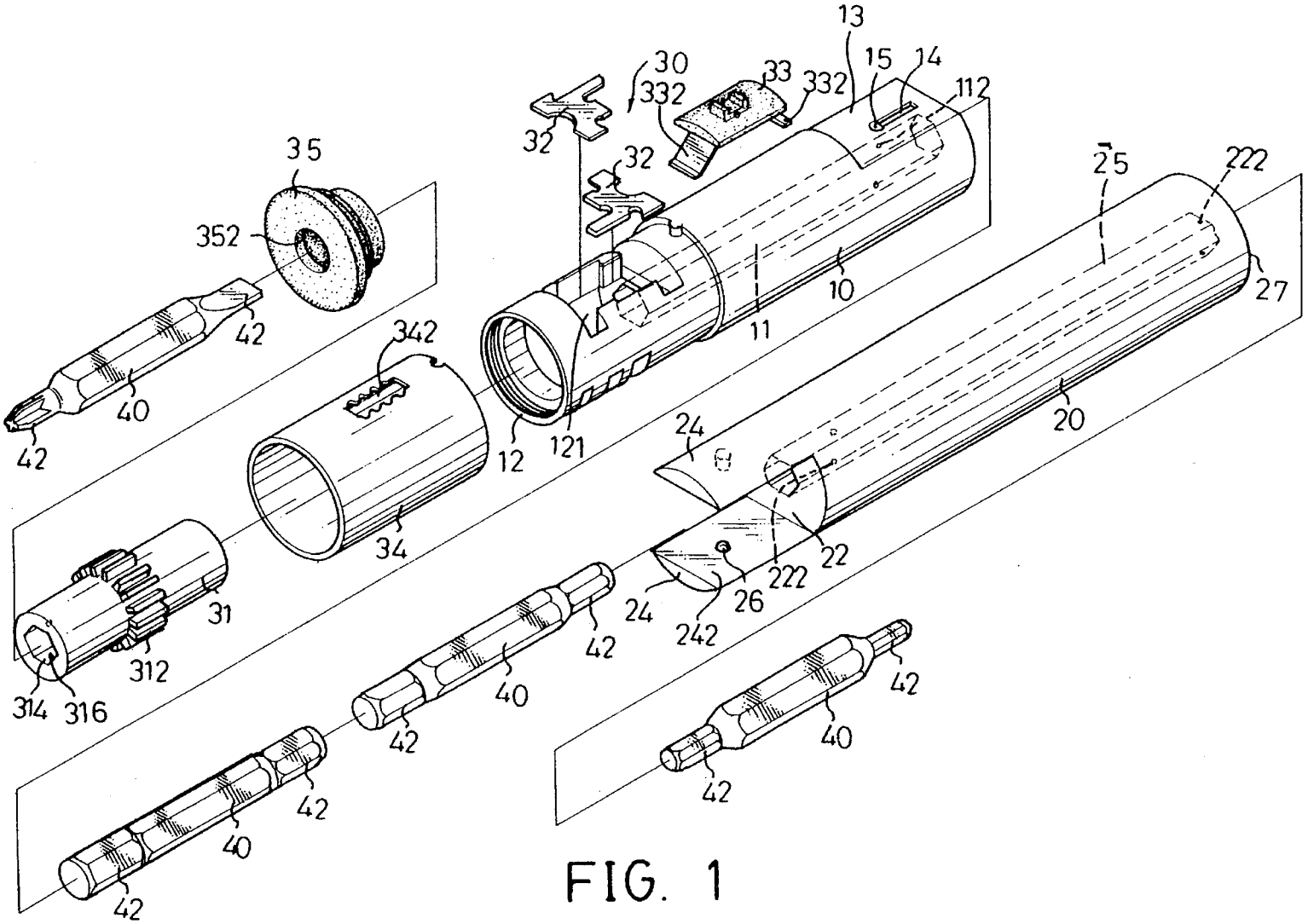
FIG. 1 is a an exploded perspective view of an embodiment of a multi-purpose tool in accordance with the present invention.
Figure 2:
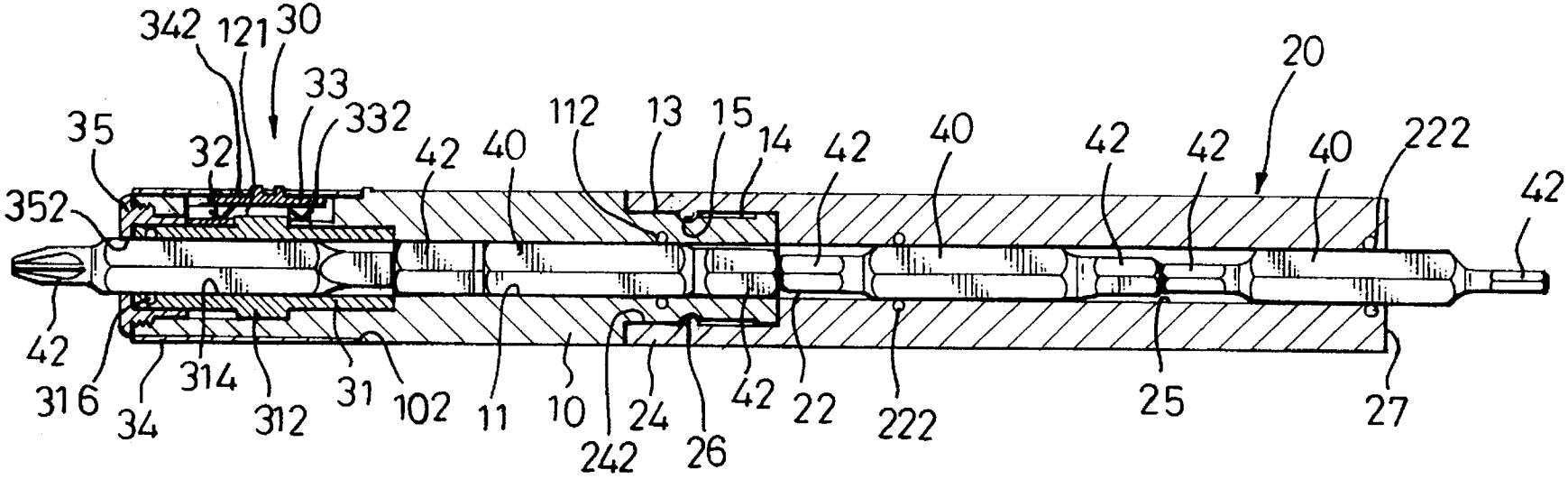
FIG. 2 is an assembled cross-sectional view of the multi-purpose tool shown in FIG. 1.

Referring to the drawings and initially to FIGS. 1 and 2, the multi-purpose tool in accordance with the present invention generally includes a head portion 10, a handle portion 20 movably coupled to the head portion 10, and a number of hexagon rods 40 received in the head portion 10 and the handle portion 20. The head portion 10 has a tubular first end 12 having a peripheral recess 121, a tenon end having two opposite peripheral cutouts 13, a central hexagon hole 11 extending from the first end to the first end 12, and a ratchet mechanism 30 coupled to the tubular first end 12. Further, each of the peripheral cutouts 13 has a longitudinal slot 14 having an enlarged ends 15 defined therein. Two ball shaped protrusions 112 extend inward from two opposite walls defining the hexagon hole 11 at a position adjacent to the second end of the head portion 10.

The ratchet mechanism 30 includes a shaft 31 received in the tubular first end 12 of the head portion 10 and having a plurality of teeth 312 outwardly extending from an outer periphery thereof and a central hexagon through aperture 314 extending from a first end to a second end thereof, two constraining elements 32 disposed in the peripheral recess 121 of the tubular first end 12 of the head portion 10, a sleeve shell 34 having a peripheral opening 342 defined in a longitudinal direction and sliding over the tubular first end 12 of the head portion 10, a switch 33 having two actuating arm 332 extending through the peripheral opening 342 to actuate the two constraining elements 32 respectively for selectively engaging respective constraining element 32 with the teeth 312, and an end cap 35 having a central hole 352 and being screwed to the first end 12 of the head portion 10 to enclose the ratchet mechanism 30. Preferably, the hexagon aperture 314 has two ball shaped protrusions 316 inwardly extending from two opposite walls defining the hexagon aperture 314. Since the operation and the structure of the ratchet mechanism 30 are similar to well known ratchet mechanism, a detailed description thereof will not be repeated herein.

The handle portion 20 has a first end 22 having two opposite ears 24 longitudinally extending from an outer periphery thereof defining a space therebetween to receive the tenon end of the head portion 10 and a central hexagon opening 25 extending from a second 27 to the first end 22 thereof. Further, each of the ears 24 has a protrusion 26 inwardly extending from an inner face 242 thereof to slide in the slot 14 of the tenon end of the head portion 10 and thereby movably coupling the handle portion 20 to the head portion 10. At either end of the hexagon opening 25, two ball shaped protrusions 222 inwardly extending from two opposite wall defining the opening 25 are provided.

The plurality of hexagon rods 40, in the present embodiment there are four hexagon rods, preferably has an outer diameter substantially equals to an inner diameter of the hexagon opening 25, the hexagon hole 11 and the hexagon aperture 34. The hexagon rods 40 are received in the hexagon aperture 314, hexagon hole 11 and the hexagon opening 25 and held in position by the ball shaped protrusions 316, 112 and 222. Each of the hexagon rods 40 has two reduced ends 42 formed into different functional shapes, for instance, a Phillips head tip, a keystone tip, and hex wrench heads of different diameters, as shown in FIG. 1. As shown in FIG. 2, the hexagon rods 40 are arranged such that a portion of one of the hexagon rods 40 extends out from the ratchet mechanism 30 and a portion of another hexagon rods 40 extends out from the second end of the handle portion 20 to allow the tool to perform different functions at each end thereof.

Figure 3A:
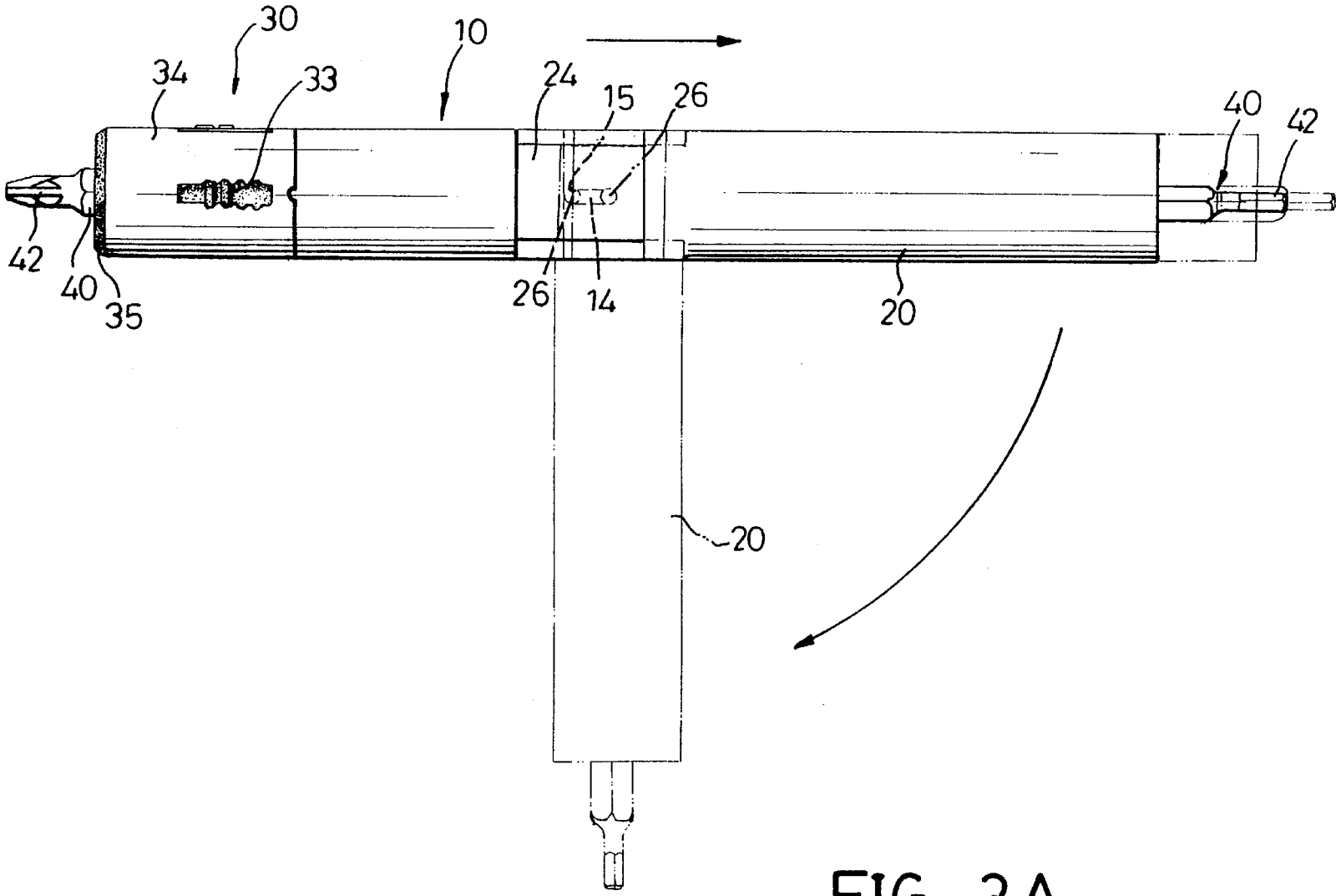
FIGS. 3A and 3B are side views illustrating the transition states of the multi-purpose tool in accordance with the present invention.
Figure 3B:
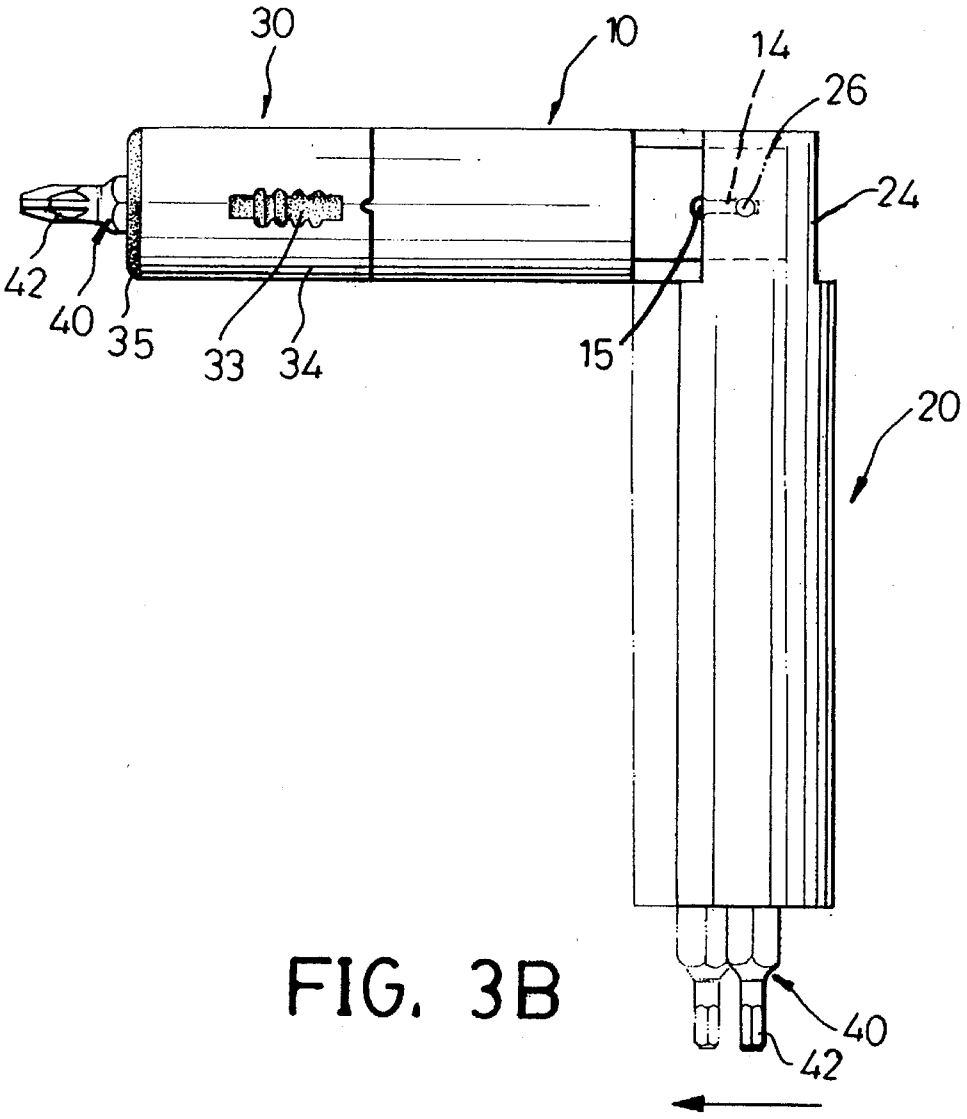

In use, referring now to FIGS. 3A and 3B, the handle portion 20 is firstly pulled backward in a direction indicated by the arrow as shown in FIG. 3A and swung 90° in relation to the head portion 10. Then the handle portion 20 is pushed forward and lock the handle portion 20 with the head portion 10 at a right angle to drive the head portion 10 or vice versa.

Figure 4:
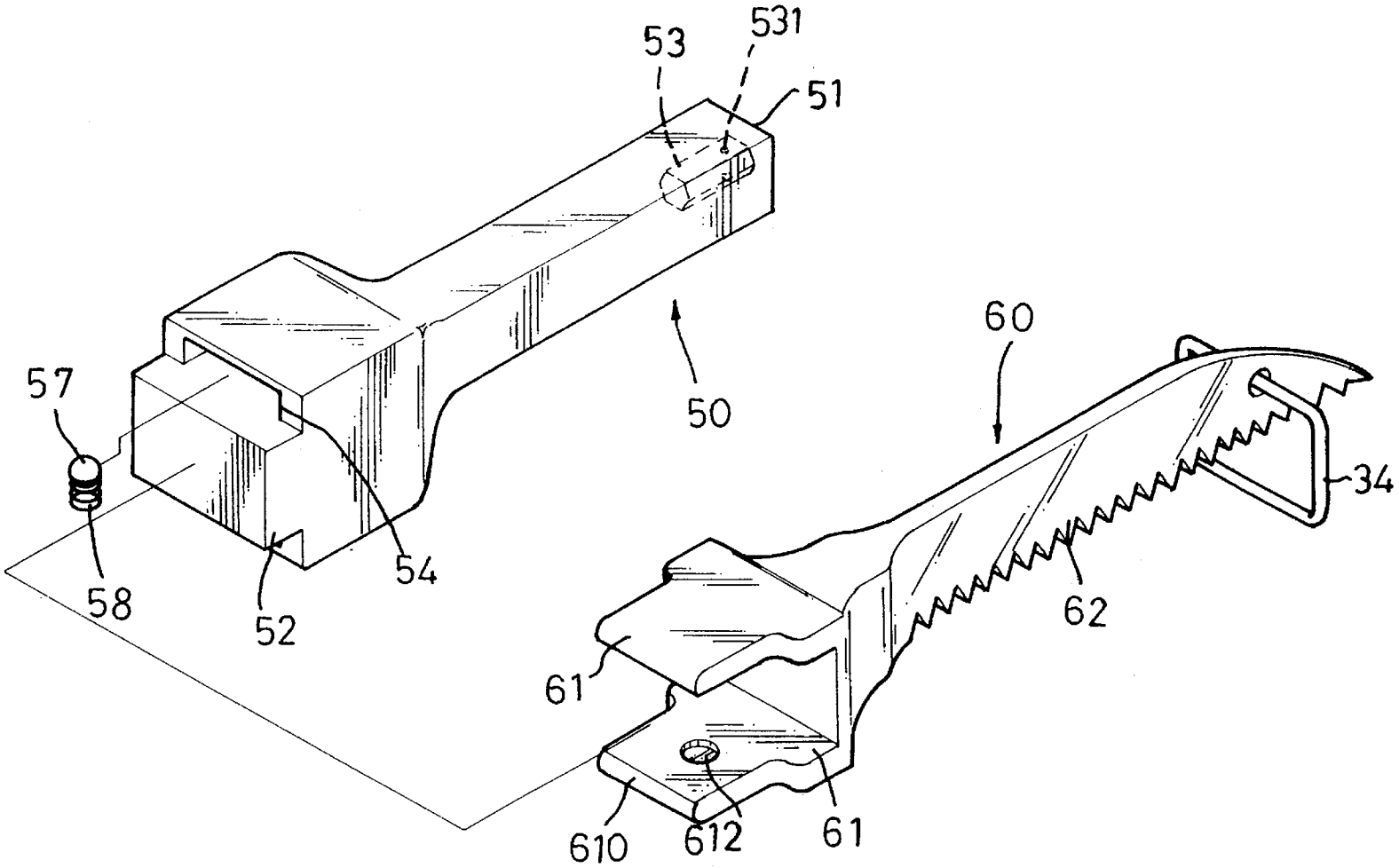
FIG. 4 is a an exploded perspective view of an extension portion and a saw blade which are to be coupled to the tool to form another embodiment of the present invention.
Figure 5:
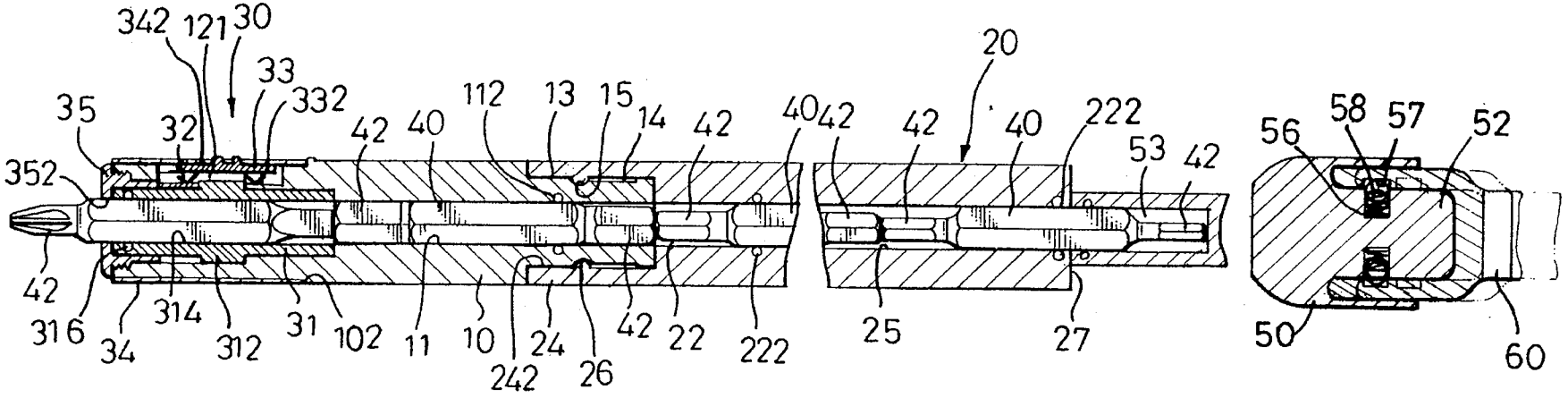
FIG. 5 is a cross-sectional view, partly broken away, of another embodiment of the present invention illustrating the interconnecting relationship between the extension portion and the handle portion, and between the tool-head component and the extension portion.

FIGS. 4 and 5 illustrate another embodiment of the present invention. A connecting portion 50 has a first end 51 coupled to the second end of the handle portion 20 by inserting the portion of the hexagon rod 40 extending out from the second end of the handle 20 into an aperture 53 defined in the first end 51 and held in position by two ball shaped protrusions inwardly formed on two opposite wall defining the opening 53, and a second end 52 having two longitudinal engaging slots 54 defined in tow opposite sides thereof. Each of the engaging slots 54 has a recess 56 defined in a horizontal wall defining the slot 54, a spring 58 received in the recess 56, and a steel ball 57 biased by the spring 58 against another horizontal wall defining the slot 54.

A tool head component 60 has a C-shaped first end comprising two tongues 61 to be inserted into the corresponding slots 54, and a functional body 62, such as a saw blade as shown in FIG. 4. Each of the tongues 61 has a rounded inclined tip 610 such that as the tongue is inserted in the slot 54 the tip can urge the steel ball into the recess 56, and a depression 612 defined in an inner face thereof for receiving the steel ball thereby releasably coupling the tool head component 60 to the connecting portion 50, as clearly shown in FIG. 5. Preferably, the functional body 62 of the tool head component 60 can be an open-end portion of a wrench, a box-end portion of a wrench, or a hammerhead of a hammer.

Although the invention has been explained in relation to its preferred embodiment, it is to be understood that many other possible modifications and variations can be made without departing from the spirit and scope of the invention as hereinafter claimed.

I claim:

1. A multi-purpose tool comprising:

a head portion having a tubular first end, a central hexagon hole defined therein extending from a second end thereof to the tubular first end and a ratchet mechanism coupled the tubular first end thereof, the ratchet mechanism comprising a central shaft having a central hexagon aperture in alignment with the central hexagon hole of the head portion;

a handle portion having a first end coupled to the second end of the head portion, a central hexagon opening defined therein extending from a second end thereof to the first end thereof and in alignment with the hexagon hole of the head portion, the handle portion being capable of pivoting about the head portion with a first axial movement of the handle portion relative to the head portion in a first direction; and a plurality of hexagon rods received in the hexagon opening, hexagon hole and the hexagon aperture of the handle portion, the head portion and the shaft of the ratchet mechanism respectively and arranged such that a portion of one of the plurality of hexagon rods extending out from the ratchet mechanism and a portion of another hexagon rod extending out from the second end of the handle portion, each of the plurality of the hexagon rods having two contracted, in diameter, ends formed into various functional shapes for performing different functions.

2. The multi-purpose tool as claimed in claim 1 wherein a holding structure is provided in a first end of the hexagon aperture of the shaft of the ratchet mechanism, the second end of the hexagon hole of the head portion, both end of the hexagon opening of the handle portion respectively to properly retain the hexagon rods in position.

3. The multi-purpose tool as claimed in claim 2 wherein the holding structure includes two ball shaped ridges slightly extending inward from two opposite walls defining the hexagon hole/opening/aperture.

4. The multi-purpose tool as claimed in claim 1 wherein the functional shapes of the hexagon rods are Allen wrenches of various diameters.

5. The multi-purpose tool as claimed in claim 1 wherein one of the functional shapes of the hexagon rods is a keystone tip of a screwdriver.

6. The multi-purpose tool as claimed in claim 1 wherein one of the functional shapes of the hexagon rods is a Phillips head tip of a screwdriver.

7. The multi-purpose tool as claimed in claim 1 wherein one of the functional shapes of the hexagon rods is a cabinet tip of a screwdriver.

8. The multi-purpose tool as claimed in claim 1 further comprising:

an connecting portion having a first end releasably coupled to the second end of the handle portion and a second end; and a tool-head component having a first end releasably coupled to the second end of the extension portion and a functional body.

9. The multi-purpose tool as claimed in claim 7 wherein the functional body of the tool-head component is an open-end portion of a wrench.

10. The multi-purpose tool as claimed in claim 7 wherein the functional body of the tool-head component is a box-end portion of a wrench.

11. The multi-purpose tool as claimed in claim 7 wherein the functional body of the tool-head component is a blade portion of a saw.

12. The multi-purpose tool as claimed in claim 7 wherein the functional body of the tool-head component is a hammer-head of a hammer.

* * * * *